US009198233B2

(12) United States Patent
Brosnan et al.

(10) Patent No.: US 9,198,233 B2
(45) Date of Patent: Nov. 24, 2015

(54) AUDIBLE NOISE MANIPULATION FOR INDUCTION COOKTOP

(75) Inventors: Daniel Vincent Brosnan, Louisville, KY (US); Gregory Francis Gawron, Sr., Jeffersontown, KY (US); Mingwei Shan, Louisville, KY (US); John Michael Kulp, Jr., Louisville, KY (US); Mariano Pablo Filippa, Auburndale, MA (US)

(73) Assignee: General Electric Company, Schenectady, NY (US)

( * ) Notice: Subject to any disclaimer, the term of this patent is extended or adjusted under 35 U.S.C. 154(b) by 1198 days.

(21) Appl. No.: 13/156,570

(22) Filed: Jun. 9, 2011

(65) Prior Publication Data

US 2012/0312804 A1 Dec. 13, 2012

(51) Int. Cl.
*H05B 6/12* (2006.01)
*H05B 6/06* (2006.01)

(52) U.S. Cl.
CPC ..... *H05B 6/065* (2013.01)

(58) Field of Classification Search
CPC ..... H05B 6/065; H05B 6/02; H05B 6/08; H05B 6/62; H05B 6/04; H05B 6/06
USPC ..... 219/600, 620, 625, 626, 662, 663, 664, 219/487, 621, 624, 647, 650, 660, 661, 665, 219/666
See application file for complete search history.

(56) References Cited

U.S. PATENT DOCUMENTS

| | | | | |
|---|---|---|---|---|
| 4,348,571 | A | 9/1982 | Dills | |
| 4,453,068 | A * | 6/1984 | Tucker et al. | 219/625 |
| 6,018,154 | A * | 1/2000 | Izaki et al. | 219/625 |
| 6,236,025 | B1 * | 5/2001 | Berkcan et al. | 219/497 |
| 7,504,607 | B2 | 3/2009 | Barragan Perez et al. | |
| 2003/0080116 | A1 * | 5/2003 | Williamson | 219/719 |
| 2008/0087661 | A1 | 4/2008 | Haag et al. | |
| 2011/0079591 | A1 | 4/2011 | Parachini et al. | |

FOREIGN PATENT DOCUMENTS

| | | |
|---|---|---|
| JP | 2003017234 | 1/2003 |
| JP | 2008257971 | 10/2008 |

* cited by examiner

*Primary Examiner* — Dana Ross
*Assistant Examiner* — James Sims, III
(74) *Attorney, Agent, or Firm* — Dority & Manning, P.A.

(57) ABSTRACT

A method for operating an induction cooktop having multiple induction heating coils includes monitoring a characteristic of the heating coils indicative of audible noise generated by simultaneous operation of multiple induction heating coils. Upon indication of audible noise from the monitored characteristic, an operating characteristic of at least one of the induction heating coils is varied so as to change the audible noise into a pre-defined, stored audible noise pattern that is desirous to a consumer or user of the cooktop.

7 Claims, 5 Drawing Sheets

AUDIBLE NOISE MANIPULATION FOR INDUCTION COOKTOP

FIELD OF THE INVENTION

The present subject matter relates to induction cooktops. More particularly, the present subject matter relates to apparatus and methodologies for changing audible noise produced by multiple induction coils of an induction cooktop.

BACKGROUND OF THE INVENTION

Induction cook tops are typically equipped with multiple induction coils that define respective cooking zones. These coils are driven by high frequency currents to produce a magnetic field that is picked up by the ferromagnetic cooking utensil (e.g., pot or pan). The induced eddy currents in the utensil cause the utensil to heat up. The power delivered to the utensil to control the heat-up rate and capacity is varied by adjusting the operating parameters of the induction coil, particularly the converter frequency and/or operating voltage.

The induction coils are typically driven at a high frequency (e.g., around 20K-50K Hz range) that is above the threshold of human hearing. An issue arises, however, when multiple coils are operated simultaneously at different frequencies. Intermodulation of the driven frequencies results in a frequency that is essentially the difference of the driven frequencies (or harmonics thereof), and which may lie in the human audible range. This noise can be an irritant to certain consumers.

Various efforts have been proposed to eliminate or suppress the induction coil noise in induction cook tops. For example, U.S. Pat. No. 7,504,607 proposes to alter the operating frequencies of multiple induction coils so that the resulting superposition frequency is either below a first cut-off frequency or above a second cut-off frequency, with the cut-off frequencies being below or above the audible threshold values. Reference is also made to U.S. Pub. No. 2001/0079591 and U.S. Pub. No. 2008/0087661.

The prior proposed solutions seek to eliminate the induction noise from simultaneously operated coils by manipulating the power and frequency characteristics of the devices to suppress the noise altogether or render the noise inaudible to humans. The present invention seeks to address the problem in a fundamentally different and novel manner.

BRIEF DESCRIPTION OF THE INVENTION

Aspects and advantages of the invention will be set forth in part in the following description, or may be obvious from the description, or may be learned through practice of the invention.

In accordance with aspects of the invention, a method is provided for operating an induction cooktop having multiple induction heating coils. The method includes monitoring a characteristic of the heating coils that is indicative of audible noise generated by simultaneous operation of multiple induction heating coils, wherein the audible noise is typically the result of the frequency difference between the driven frequencies. Upon indication of audible noise from the monitored characteristic, the method includes varying an operating characteristic of at least one of the induction heating coils so as to change the audible noise into a pre-defined, stored audible noise pattern that is desirous to a consumer or user of the cooktop. This pre-defined audible noise pattern may be, for example, a jingle, musical piece, repeating rhythmic tones, or any other noise pattern deemed pleasing to the individual.

In a particular embodiment, the pre-defined audible noise pattern is stored in a controller or memory associated with the controller, with the controller varying the operating characteristic of one or more of the induction heating coils in a closed-loop feedback circuit to generate the pre-defined audible noise pattern. The audible noise may be monitored with an audio receiver that is in communication with the controller in the closed-loop feedback circuit.

Embodiments of the method may include storing a plurality of the pre-defined audible noise patterns in the controller or associated memory, wherein an individual may select a particular jingle, musical piece, etc., from the plurality of stored noise patterns.

In a particular embodiment, the monitoring step includes detecting actual audible noise with an audio receiver that is in communication with the controller in the closed-loop feedback circuit.

In a different embodiment, the monitoring step includes deriving operating drive frequency and magnitude for the induction coils from sensed current through the induction coils, wherein audible noise is indicated when the frequency differential between the drive frequencies lies in the audible frequency range.

In still a further embodiment, the monitoring step includes deriving operating drive frequency and magnitude for the induction coils from a voltage detected in an inverter that supplies the induction coil, wherein audible noise is indicated when the frequency differential between the drive frequencies lies in the audible frequency range.

The operating characteristic that may be varied to produce the pre-defined audible noise pattern may be any one or combination of frequency, switching time, or power of the induction heating coils. In addition, the operating characteristics may be controlled to also maintain an average power for the induction heating coils that corresponds to a power setting selected for the individual induction coil.

In a particular embodiment, the operating characteristic that is varied is the switching times of multiple induction heating coils so that the pre-defined audible noise pattern includes periods of no audible noise. In a different embodiment, the operating frequency of at least one of the induction heating coils is varied in a repeatable pattern such that the audible noise generated as a result of the frequency difference between the induction heating coil and at least one other induction heating coil is in accordance with the pre-defined audible noise pattern. The operating frequency of both of the induction heating coils may be varied for the same purpose.

The present invention also encompasses any manner of induction cooktop that incorporates aspects discussed above. For example, the cooktop may include a plurality of induction heating coils, with an inverter configured to supply energy to each of the induction heating coils. A controller is in communication with a feedback sensing circuit configured to monitor a characteristic of the induction heating coils that is indicative of audible noise generated by simultaneous operation of the induction heating coils. The controller is configured to vary an operating characteristic of at least one of the operating induction heating coils to change the audible noise into a pre-defined audible noise in a closed-loop feedback circuit.

Other embodiments of induction cooktops may incorporate any one or combination of the other features discussed above and described in greater detail below.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
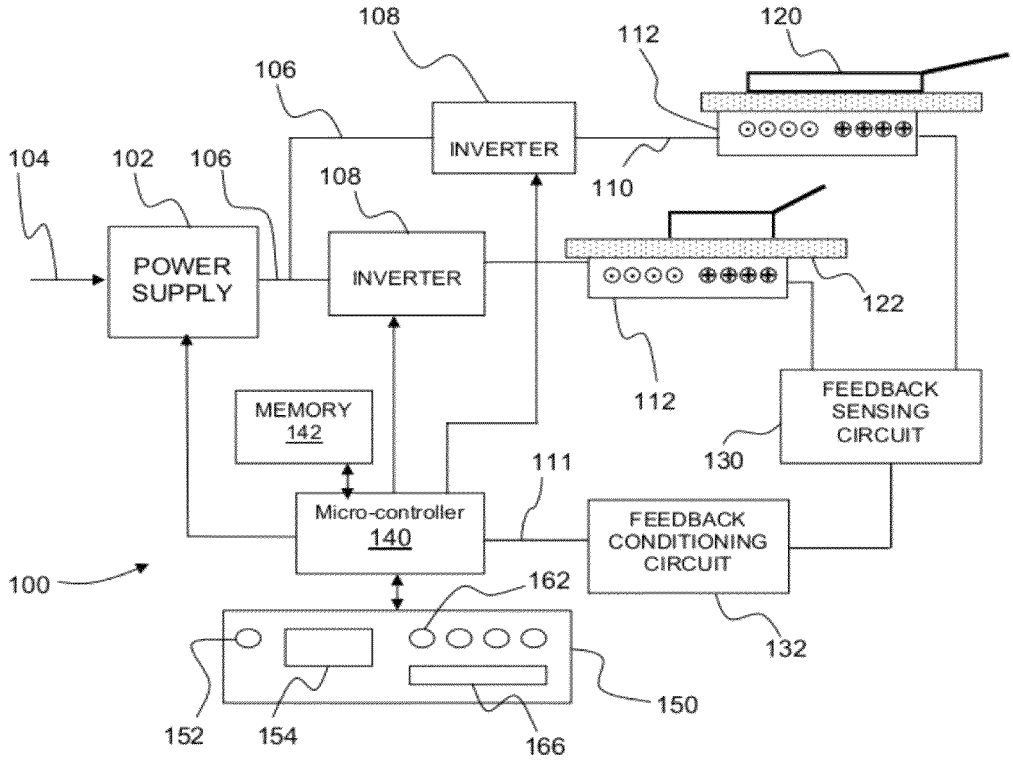
FIG. 1 is a schematic block diagram of a portion of an induction cooking appliance.

Repeat use of reference characters throughout the present specification and appended drawings is intended to represent same or analogous features or elements of the invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As noted above, the present subject matter is directed toward apparatus and methodologies for operating an induction cooktop having multiple induction heating coils in a manner so as to manipulate or change audible noise produced by the heating coils into a pre-defined audible noise pattern that is desired by a consumer or user of the appliance.

With reference now to FIG. 1, there is illustrated a schematic block diagram of a portion of an induction cooking appliance 100. Appliance 100 may include a power supply 102 configured to receive an alternating current (AC) input via input power line 104 from, for example, a residential source such as a home outlet. Power supply 102 may be configured to provide a direct current (DC) output voltage on output line 106 to supply operational power to a half bridge resonant power inverters 108. Each inverter 108 is configured to supply operating power to a respective induction cooking coil 112 by way of output line 110 from inverter 108. In an exemplary configuration, the inverters 108 may operate as a high frequency, high current power source for the respective coil 112. In an exemplary configuration, the operating frequency for inverter 108 by range from 20-50 KHz while the supplied current to coil 112 may typically range from 0-40 Amps RMS.

As will be understood by those of ordinary skill in the art, current through coil 112 creates a magnetic field that will be coupled into a cooking utensil 120 (e.g., pot or pan) through, for example, a glass support surface 122, thereby creating eddy currents in utensil 120 that will heat the utensil. The amount of magnetic field that can be coupled into utensil 120 is most directly a function of the utensil's size/shape, placement relative to the coil, material, and the proximity of the inverter to system resonance.

The induction cooking appliance 100 may be provided with features that can be utilized to detect actual or inferred audible noise generated by simultaneous use of the induction coils 112, and to change or modify the operating characteristics of the operating coils 112 so that the resulting audible noise is in accordance with a pre-defined noise pattern. These features may be provided using components, signals, and sub-systems that, in most instances, may already be present in the appliance.

Referring to FIG. 1, a feedback sensing circuit 130 is operatively disposed to monitor a characteristic of the operating induction coils 112 that is indicative of audible noise resulting from simultaneous use of the coils 112. The monitored characteristic can vary between different embodiments. A conditioning circuit 132 may be provided downstream from the feedback sensing circuit 130 to convert the signal or signals from the sensing circuit 130 into a feedback signal 111 used by a micro-controller 140 in a closed-loop feedback control scheme. The feedback sensing circuit 130 and conditioning circuit 132 may be any hardware and software combination configured for performing the intended functions.

Figure 2:
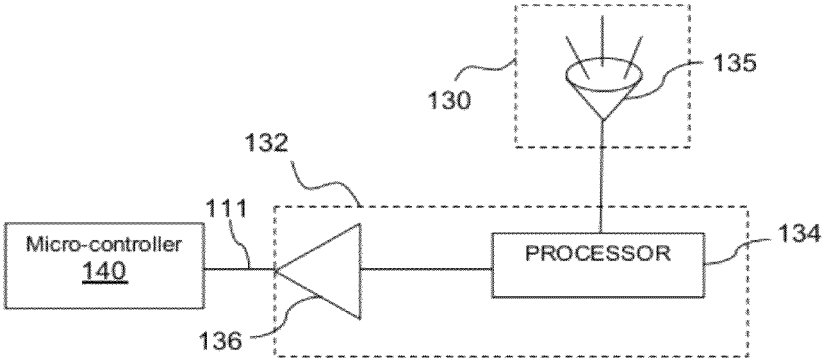
FIG. 2 is a diagram of a feedback sensing mechanism that uses an audio receiver to detect actual noise generated by the induction coils.

In a particular embodiment depicted in FIG. 2, the feedback sensing circuit 130 is configured to detect actual audible generated by simultaneous operation of the induction coils 112, and may include any manner of suitable audio receiver 135 disposed at a position to detect audible noise generated by the induction coils 112. The audio receiver 135 may be a single device, or a combination of devices strategically located throughout the appliance 100. The detected noise signal may be transmitted to a processor 134, an amp 136, and to the controller 140. The processor 134, amp 136, and controller 140 may include any manner of software and hardware configuration that converts the analog noise detected by the receiver 135 into a digital file or signal 111 in a format used by the micro-controller 140 in the feedback control loop. The devices may include, for example, any manner of DSP, audio signal processor, and the like.

Figure 3:
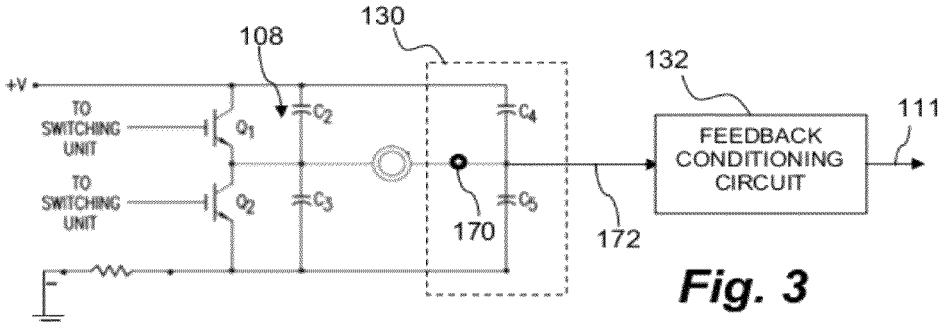
FIG. 3 is a schematic block diagram of an alternate embodiment of a feedback sensing mechanism.

In an alternate embodiment depicted in FIG. 3, the characteristic of the induction coils 112 monitored by the feedback sensing circuit 130 is current through the respective coils 112. A current transformer may be operatively configured with the inverter 108 that generates an output current signal 172. The feedback conditioning circuit 132 derives the drive frequency and magnitude of the induction coils 112 from the current signal 172 and generates a signal representing the differential frequency between the drive frequencies. This differential frequency signal is received by the micro-controller 140.

Figure 4:
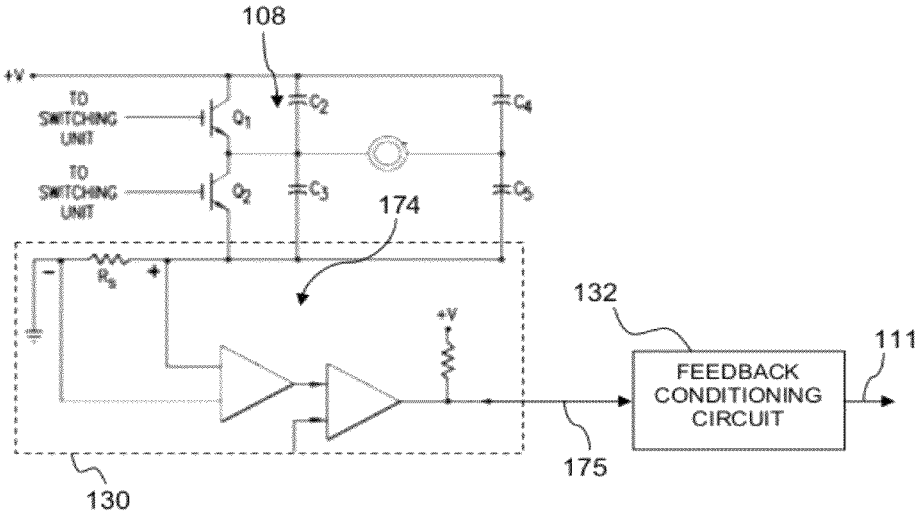
FIG. 4 is a schematic block diagram of still another embodiment of a feedback sensing mechanism.

In the embodiment depicted in FIG. 4, the characteristic of the induction coils 112 monitored by the feedback sensing circuit 130 is inverter voltage, which may be detected by measuring the voltage across a resistive shunt, as in the voltage detector 174 depicted in FIG. 4. The feedback conditioning circuit 132 derives the drive frequency and magnitude of the induction coils 112 from the voltage signal 175 and generates a signal representing the differential frequency between the drive frequencies. This differential frequency signal is received by the micro-controller 140.

It should be appreciated that the functions of the conditioning circuit 132 may be implemented in the micro-controller 140.

The feedback signal 111 (FIG. 1) is applied to an input of the micro-controller 140, which is also in communication with a memory 142 that may include a library of stored, pre-defined audio noise patterns. In an alternate embodiment, the memory function may be incorporated directly in the controller 140, and may contain only a single pre-defined audible noise pattern. These noise patterns may be, for example, a jingle, musical piece, repeating rhythmic tones, or any other noise pattern that is within the realm of production by modulation of the simultaneous drive frequencies of the induction coils 112. Those of ordinary skill in the art will appreciate that micro-controller 140 may also correspond to a micro-processor, a micro-computer, an application specific integrated circuit (ASIC) device, or any other suitable device capable of processing the input audio input signal and generating output control signals suitable for controlling components of induction cooking appliance 100 in order to produce the pre-defined audible noise patterns.

Referring still to FIG. 1, a control panel 150 may be provided with a number of control elements 152, 162, 164 and a representative pair of display elements 154, 166 that allow a user to select and control the various operational features of the appliance 100 through the controller 140, or through another system controller. In an embodiment wherein the memory 142 contains various different pre-defined audible noise patterns, one of the control elements and displays may be configured so that a user can access the memory 142 and select a particular noise pattern from the available noise patterns. For example, holiday-themed jingles may be selected by a user during particular holidays or events, and so forth.

The micro-controller 140 may operate a comparison routine in a closed-loop feedback circuit wherein the received feedback signal 111 is compared to the pre-defined audio noise signal. Operating parameters of the induction coils 112 are changed or modified by commands from the controller 140 to modulate the received audio noise signal into accordance with the stored audio noise pattern (within acceptable limits). Various closed-loop control schemes may be used in this regard, and the invention is not limited to any particular control scheme.

As mentioned above, any combination of the operating characteristics of one or more of the induction heating coils 112 may be modified or varied in the closed-loop feedback control scheme in order to generate the pre-defined audible noise pattern. These characteristics may include any one or combination of frequency, switching time, power supplied to the heating coils, and so forth. Regardless of the combination of controlled characteristics, it is desirable that the induction coils 112 are controlled so as to maintain an average power for the coils 112 that corresponds to the power setting or rating selected by the user for the individual induction coil 112. For example, if the user selected a "medium" or "low" setting, then the average power for the respective heating coil 112 (taking into consideration the various modified characteristics that result in the pre-defined audible noise pattern) should deliver the rated power for the respective power setting.

Figure 5:
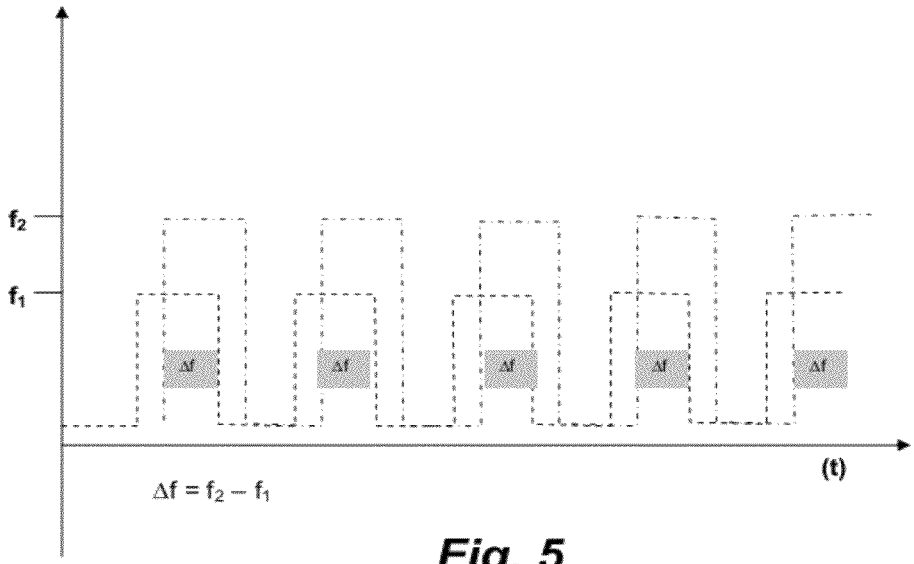
FIG. 5 is a graph depicting an operational manipulation of driven frequencies over time in an induction cooktop to achieve a pre-defined audible noise pattern.

FIG. 5 depicts a switching time scheme for two individual induction coils, wherein one of the coils is operated at frequency $f_1$ and the other coil is operated at frequency $f_2$. The switching times for the respective coils are slightly offset so that the coils are operated simultaneously for incremental time periods, as indicated by the Δf notations in FIG. 2. During these overlapping periods, an audible noise is generated at a frequency that corresponds essentially to the Δf frequency ($f_2-f_1$). It can thus be appreciated from FIG. 5 that, by controlling the switching times while maintaining frequencies $f_1$ and $f_2$ at their operating frequency, a repeating audible noise pattern is produced corresponding to a staggered pattern of noise/no noise/noise/no noise . . . , wherein the audible noise is distinct and corresponds to the Δf characteristic. It should be further appreciated from FIG. 5 that by varying either one of the operating frequencies, the Δf characteristic also changes, and thus the intermittent audible noise changes.

Figure 6:
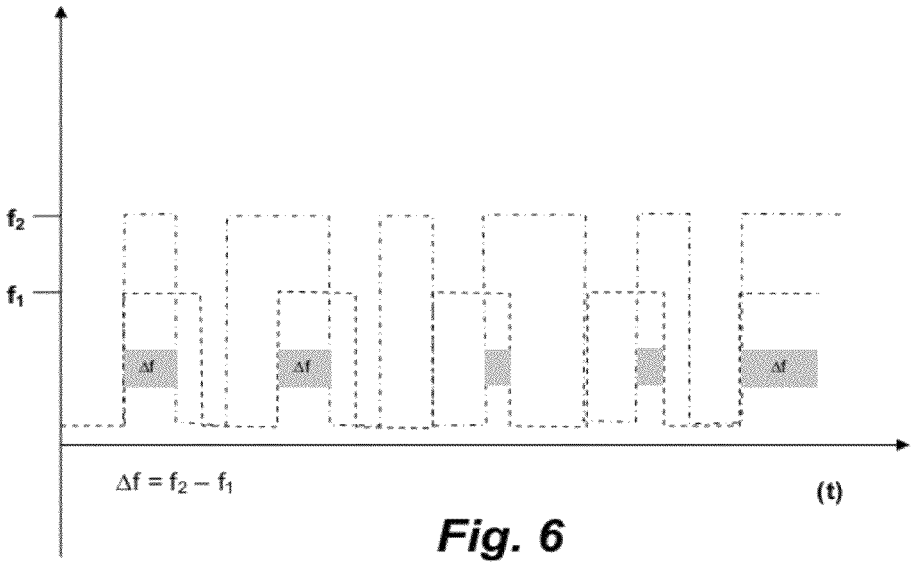
FIG. 6 is a graph of an alternate manipulation technique for achieving a pre-defined audible noise pattern.

FIG. 6 is a further depiction of a frequency/switching time graph wherein the switching scheme for the induction coil operating at $f_2$ is modified such that shorter "on" times are interspersed between longer "on" times, as depicted in FIG. 6. The switching times for the induction coil operating at $f_1$ is steady in the pattern illustrated in figure. It can thus be seen from FIG. 6 that the overlapping periods wherein the coils are simultaneously "on" varies along the time access. It should thus be appreciated from this figure that, by varying the switching times between one or both of the induction coils 112, that varying pre-defined patterns of audible noise can be generated. These patterns can be controlled by the controller 140 in the closed-loop feedback scheme so that the generated noise pattern depicted by the shaded areas in FIGS. 5 and 6 matches (within acceptable ranges) a pre-defined audible noise pattern retrieved from the memory 142 by the controller 140.

Figure 7:
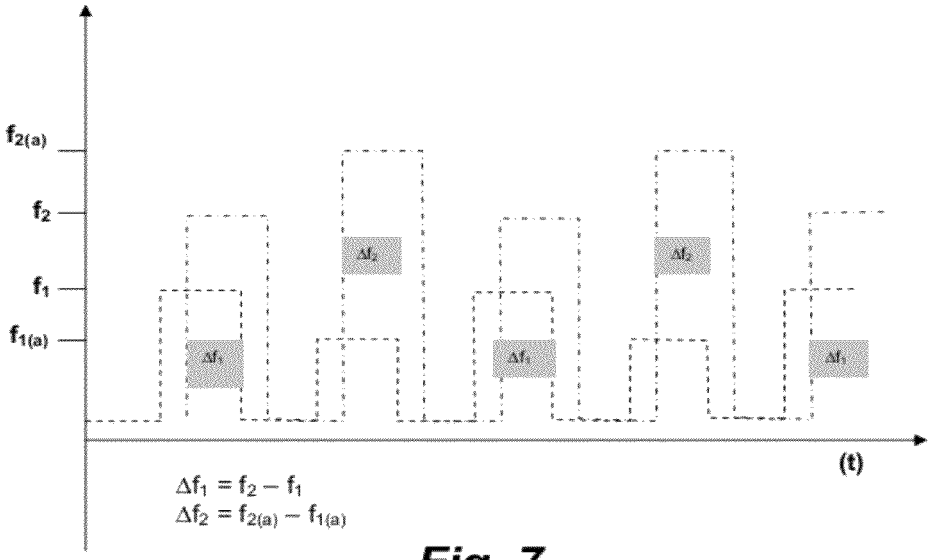
FIG. 7 is a graph of another manipulation technique for achieving a pre-defined audible noise pattern.

FIG. 7 depicts yet another modulating scheme wherein the switching times of the coils are maintained relatively constant, but the operating frequencies of the coils at the "on" state are varied. For example, the coil operating at frequency $f_1$ varies from frequency $f_1$ to frequency $f_{1(a)}$. Likewise, the coil operating at frequency $f_2$ varies from frequency $f_2$ to frequency $F_{2(a)}$. Thus, during the simultaneously "on" overlapping time periods, the generated noise varies as a function of the varying Δf characteristic, as depicted by the shaded areas in FIG. 7.

Figure 8:
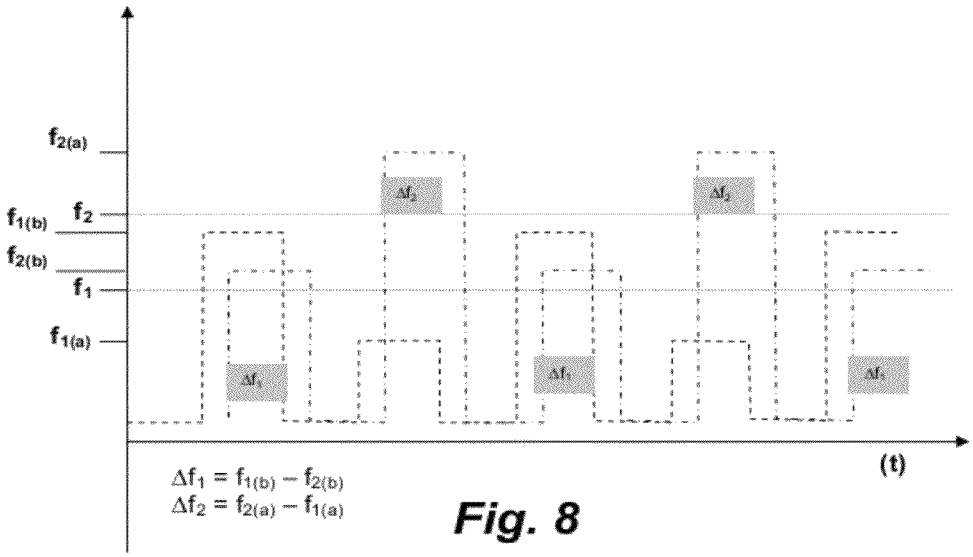
FIG. 8 is a graph of yet another different manipulation technique for achieving a pre-defined audible noise pattern in an induction cooktop.

FIG. 8 depicts yet another modulation scheme wherein the operating frequencies of each of the respective induction coils is altered between a high and low frequency relative to their respective base frequencies $f_1$ and $f_2$. For example, the induction coil that operates at frequency $f_1$ will, during simultaneous operation with the induction coil operating at frequency $f_2$, be cycled during its "on" period from frequency $f_{1(a)}$ to $f_{1(b)}$. Likewise, the induction coil that would normally operate at base frequency $f_2$ is cycled between frequencies $f_{2(a)}$ and $f_{2(b)}$, as depicted in FIG. 8. The resulting audible noise pattern is depicted by the shaded areas in FIG. 8 wherein $\Delta f_1$ is audibly different from $\Delta f_2$. Again, this type of modulation scheme may be utilized by the controller 140 in combination with any of the other modulation schemes to produce the pre-defined audible noise pattern.

Figure 9:
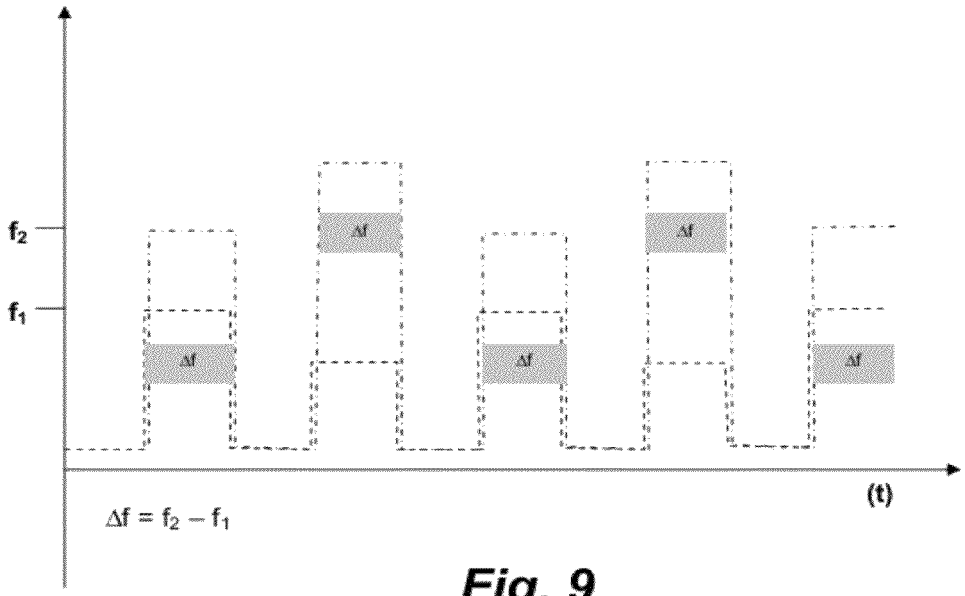
FIG. 9 is a graph of still another alternate manipulation technique for achieving a pre-defined audible noise pattern in an induction cooktop.

FIG. 9 is yet another depiction scheme wherein the switching times for the respective coils operating at $f_1$ and $f_2$ are coincident. Thus, the overlapping "on" periods correspond to the complete "on" periods for each respective coil. In this scheme, the resulting audible noise corresponding to the Δf characteristic is purely a function of the difference between $f_2$ and $f_1$.

It should also be appreciated that the present invention encompasses any manner of induction cook top 100 (FIG. 1) that incorporates operating features as discussed above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An induction cooktop, comprising:

a plurality of induction heating coils;

an inverter configured to supply energy to each of said plurality of induction heating coils;

a feedback sensing circuit configured to monitor a characteristic of said induction heating coils that is indicative of audible noise generated by simultaneous operation of said plurality of induction beating coils;

a conditioning circuit configured to receive one or more signals associated with the monitored characteristic from the feedback sensing circuit, and to convert the one or more received signals into one or more digital signals indicative of the audile noise; and a controller in communication with said feedback sensing circuit, said conditioning circuit and said induction heating coils, the controller comprising one or more processors and one or more memory devices, the one or more memory devices storing computer-readable instructions that when executed by the one or more processors cause the one or more processors to perform operations, the operations comprising;

varying an operating characteristic of at least one of said operating induction heating coils based at least in part on the one or more digital signals to change the audible noise into a pre-defined audible noise pattern stored in the controller or a memory accessible by the controller based at least in part on a signal received from said feedback sensing circuit.

2. The induction cooktop as in claim 1, wherein said controller is configured to vary any one or combination of frequency, switching time, or power of said induction heating coils.

3. The induction cooktop as in claim 2, wherein said controller is configured to maintain an average power for each of said plurality of induction heating coils that corresponds to a power setting selected for said induction heating coil.

4. The induction cooktop as in claim 1, wherein said controller comprises a plurality of said pre-defined audible noise patterns that are selectable by a user of said cooktop.

5. The induction cooktop as in claim 1, wherein said feedback sensing circuit comprises an audio receiver that detects actual noise generated by simultaneous operation of said plurality of induction coils.

6. The induction cooktop as in claim 1, wherein said feedback sensing circuit comprises a current detector disposed to detect current through said plurality of induction coils, wherein operating drive frequency and magnitude of the plurality of induction coils is derived from the coil current and audible noise is indicated when the frequency differential between the drive frequencies lies in the audible frequency range.

7. The induction cooktop as in claim 1, wherein said feedback sensing circuit comprises a voltage detector disposed to detect a voltage in said inverter, wherein operating drive frequency and magnitude of the plurality of induction coils is derived from the inverter voltage and audible noise is indicated when the frequency differential between the drive frequencies lies in the audible frequency range.

* * * * *